US005845623A

United States Patent [19]

Blizard et al.

[11] Patent Number: 5,845,623

[45] Date of Patent: Dec. 8, 1998

[54] VARIABLE VOLUME CHAMBER DEVICE FOR PREVENTING LEAKAGE IN AN OPEN NOZZLE INJECTOR

[75] Inventors: Norman C. Blizard; Raymond J. Amlung; George L. Muntean, all of Columbus; Edward D. Smith, Greensburg; Mark Pounder; Dan K. Vetters, both of Columbus, all of Ind.

[73] Assignee: Cummins Engine Company, Inc., Columbus, Ind.

[21] Appl. No.: 899,318

[22] Filed: Aug. 13, 1997

Related U.S. Application Data

[60] Provisional application No. 60/072,100, Jun. 27, 1997.

[51] Int. Cl.[6] ..... F02M 41/00

[52] U.S. Cl. ..... 123/467; 123/198 DB

[58] Field of Search ..... 123/198 DB, 467, 123/198 D, 447, 456, 516

[56] References Cited

U.S. PATENT DOCUMENTS

| | | | |
|---|---|---|---|
| 4,064,855 | 12/1977 | Johnson . | |
| 4,092,964 | 6/1978 | Höfer et al. . | |
| 4,280,659 | 7/1981 | Gaal et al. . | |
| 4,361,121 | 11/1982 | Clemens | 123/198 DB |
| 4,559,914 | 12/1985 | Flaig | 123/198 DB |
| 4,565,170 | 1/1986 | Grieshaber | 123/198 DB |
| 4,782,808 | 11/1988 | Bostick et al. . | |
| 5,076,227 | 12/1991 | Krieger | 123/198 DB |
| 5,088,463 | 2/1992 | Affeldt et al. . | |
| 5,159,911 | 11/1992 | Williams et al. . | |
| 5,299,738 | 4/1994 | Genter et al. . | |
| 5,339,785 | 8/1994 | Wilksch . | |
| 5,445,323 | 8/1995 | Perr et al. . | |
| 5,456,233 | 10/1995 | Felhofer | 123/447 |
| 5,537,980 | 7/1996 | Yamamoto . | |
| 5,619,970 | 4/1997 | Collingborn | 123/447 |

FOREIGN PATENT DOCUMENTS

| | | |
|---|---|---|
| 9706364 | 2/1997 | WIPO . |

*Primary Examiner*—Carl S. Miller
*Attorney, Agent, or Firm*—Sixbey, Friedman, Leedom & Ferguson; Charles M. Leedom, Jr.

[57] ABSTRACT

A leak prevention device including an expandable chamber and control valve for preventing fuel leakage into the combustion chambers of a internal combustion engine equipped with a common rail fule injection system including open nozzle injectors and a shut off valve mounted in the common rail upstream of the fuel injectors to isolate, when closed, the fuel injectors from the source of fuel under pressure. The expandable chamber contains a variable volume held in its collapsed condition during engine operation and expanded upon engine shutdown sufficiently to prevent the flow of fuel from any injector into the corresponding combustion chamber. The control valve may be a three way valve for controlling the expansion of the variable volume of the expandable chamber The leak prevention device includes a housing assembly connected with a fuel drain and contains an outlet passage fluidically connected at one end with the variable volume and at the other end with the fuel drain and an outlet check valve for allowing fuel to flow in only one direction from the variable volume into the fuel drain. A control circuit is provided to energize solenoids for operating the shut off valve and control valve.

16 Claims, 7 Drawing Sheets

START OF METERING

END OF METERING

END OF INJECTION

START OF PLUNGER RETRACTION

VARIABLE VOLUME CHAMBER DEVICE FOR PREVENTING LEAKAGE IN AN OPEN NOZZLE INJECTOR

This application claims the priority of Provisional application, Ser. No. 60/072,100 filed Jun. 27, 1997 naming the same inventors and entitled: VARIABLE VOLUME CHAMBER DEVICE FOR PREVENTING LEAKAGE IN AN OPEN NOZZLE INJECTOR.

TECHNICAL FIELD

This invention relates to a leakage prevention device for use in a fuel system for a compression ignition internal combustion engine equipped with unit fuel injectors of the open nozzle type.

BACKGROUND

The assignee of this invention, Cummins Engine Company, Inc., has pioneered the development of an open nozzle fuel injection system for compression ignition engines that optimizes desirable performance objectives but avoids some of the high cost associated with other types of fueling systems for such engines. See for example U.S. Pat. No. 4,280,659 to Gals et al. Of particular importance in achieving reduced cost in the Cummins system is the absence of a pressure operated tip valve to form a "closed nozzle" injector. Prior art injector designs, such as illustrated in U.S. Pat. No. 4,092,964, often require a closed nozzle for accurate metering and, thus, the open nozzle Cummins design enjoys a cost advantage because no pressure operated tip valve is required.

One of the problems associated with ignition compression engines equipped with the Cummins open nozzle injection system, however, has been the tendency to experience excessive premature or irregular combustion causing "knock", excessive noise and/or even resistance to start up shortly after being shut off. For example, three to twenty minutes following shut off this phenomena can occur. This problem is known as the "hot start" problem. The severity of the problem is dependent primarily on starting system capability, engine temperature, type of fuel and compression ratio.

The severity of the hot start problem can range from the engine not cranking through the first compression stroke until the engine has cooled for several minutes, to the engine cranking normally and starting after hesitating slightly on the first compression stroke. Certain specific Cummins open nozzle fuel systems, such at the PT fixed time (and step timed fuel system and more recently the HPI PT fuel system (for QSK 19 and QV45/60 engines), are particularly susceptible to the hot start problem. Examples of HPI PT injector systems are disclosed in SAE Technical Paper 961748; U.S. Pat. Nos. 5,299,738 to Genter et al. and 5,445,323 to Perr et al.; and PCT International Application WO 97/06364 to Peters et al.

Open nozzle fuel systems such as HPI PT allow at least ⅓ of the injectors installed on a particular engine to be open to the combustion chamber during and after shutdown. Such injectors receive fuel from a common fuel supply rail and have cam operated plunger assemblies including an inner plunger that, upon retraction, forms a metering chamber that is in fluid communication with a fuel metering port and in fluid communication through open injection orifices with the associated combustion chamber. The inner plunger includes an annular recess spaced outwardly from the plunger tip to form a scavenge flow path. When the plunger is advanced inwardly, the annular recess aligns with a fuel scavenging port whereby fuel is caused to flow through the injector to remove undesirable gases in the fuel lines and to cool the injector. Fuel that is in the common rail after shutdown may flow either through the scavenge ports to drain (for the other ⅔ of the injectors) or "dribble" or leak into the combustion chambers of the "open" injectors.

When the engine is shut off "hot" and restarted within 10 minutes, the leaked fuel may bum in addition to the normal starting fuel, causing irregular, uncontrolled combustion which is heard as a "knock" during starting. This noise is not acceptable to some users. In some extreme cases, the "knocking" combustion can resist the starter and cause hard starting or could even result in premature starter motor failure or damage to other components such as pistons.

The hot start problem is aggravated by the presence of an "overhead tank" in some off-highway industrial applications. The additional back pressure on the scavenge circuit caused by the provision of a check valve used in such applications further resists normal scavenging and increases the amount of fuel that leaks or dribbles from the open injectors into some of the cylinders.

There is a Hot Start Knock kit available for certain compression engines, such as the N14 manufactured by the Cummins Engine Company, Inc., for eliminating a similar problem on PT and STC engines. This system, disclosed in U.S. Pat. No. 5,159,911 to Williams et al, relies on gear pump suction to create a vacuum in a chamber to evacuate the rail after the fuel shut off valve (FSOV) in the common rail is closed. A normally open control valve is allowed to close (after key-off of the FSOV) to cause rail pressure to be drained to the vacuum chamber and eventually back to the suction side of the gear pump. A similar approach has been used but it eliminated the vacuum tank, using instead the fuel filter head as a sort of vacuum chamber. Neither approach will work with overhead tanks because of their attendant positive pressure head. If a normally open valve were connected between an overhead tank and the common fuel supply rail, fuel would flow from the tank to the rail and fill ⅓ of the cylinders, hydraulically locking the engine.

Other approaches which have been tried with limited success are:

- delaying the opening of the FSOV during cranking to permit the engine to "purge" itself of the dribbled fuel before introducing new fuel. However, this causes an unacceptable delay between key-on and cranking.
- removing the "guts" of the drain line check valve to reduce restriction on the scavenge circuit of the injectors, thereby encouraging fuel in the metering rail to flow to the drain rather than the cylinders. This may be a preferred approach for non-overhead tank applications but still does not address the overhead tank back pressure problem.
- various re-locations of the normally closed FSOV, metering and timing circuit plumbing and restrictions.

Fuel injectors having closed nozzle tip valves have inherently greater ability to control fuel leakage into the combustion chambers of the engine upon shut off. Such leakage is known to be disadvantageous in certain types of non-Cummins type fuel injection systems. For example, the patent to Bostick et al. (U.S. Pat. No. 4,782,808) discloses a fuel injection system employing solenoid controlled, closed nozzle injectors wherein pressure is relieved upon engine shut off in the fuel supply line leading to the injectors. This pressure relief is designed to prevent fuel leakage through the injectors and into the cylinders, col. 3, lines 57–58. Additionally, this reference teaches that the pressure in the fuel supply line can be decreased after engine shut off by expanding the volume of the fuel supply line by using, for example, a bellows configuration, col. 5, lines 14–16. The purpose of the Bostick et al. system is disclosed to be the reduction in the tendency for carbon and varnish to form in the injectors due to heat build up immediately after engine shut off.

The type of fuel injection system disclosed in the Bostick et al. patent is typically used on gasoline, spark ignition engines which are typified by far lower injection pressures. This lower pressure allows the use of only a single fuel pump for creating the requisite injection pressure for all of the engine cylinders. In compression ignition engines, the need for much higher injection pressures makes desirable the use of individual cam operated unit injectors positioned adjacent each engine cylinder to avoid the complications associated with directing and controlling remotely the high pressure injection event at each cylinder. For example, unit injectors avoid the negative effects of pressure waves that would otherwise arise if fuel were supplied at the requisite injection pressure through relatively long conduits.

Other examples of fuel injection system that operate to relieve the pressure in the fuel lines leading to the injector nozzles are illustrated in U.S. Pat. Nos. 4,064,855 to Johnson, 5,088,463 to Affeldt et al., 5,339,785 to Wilksch and 5,537,980 to Yamamoto but none of these systems incorporates open nozzle unit fuel injectors where some of the injectors may actually provide an open path from a fuel supply line into a corresponding combustion chamber during the metering phase of injector operation. The U.S. Pat. No. (5,537,980) to Yamamoto specifically discloses the concept of using the absence of feed pressure from a the fuel pump to cause fuel to be vented from a high pressure fuel reservoir upon engine shut off.

Accordingly, an unmet need exists for a fuel system that consistently prevents fuel leakage from open nozzle injectors which may be stopped in a metering phase in which the associated combustion chamber is fluidically connected with a common fuel supply rail.

SUMMARY OF THE INVENTION

A primary object of the subject is to overcome the deficiencies of the prior art by providing a relatively simple device for preventing leakage of fuel from open nozzle injectors into the associated combustion chambers of an internal combustion engine upon engine shut off.

Another object of this invention is to prevent leakage of fuel into the combustion chamber of an internal combustion engine equipped with open nozzle fuel injectors by using a known hydraulic phenomena, namely, a volume of fuel in a fixed container with rigid walls, if pressurized, will retain its pressure indefinitely unless (a) some fuel leaks out, or (b) the volume is allowed to expand. In particular, the subject invention provides an expansion volume connected with the engine's common rail downstream of the normal Fuel Shut-off Valve (FSOV) and upstream of the open nozzle unit injectors. During shutdown, after the FSOV closes, the expansion volume increases and allows fuel in the common rail to move into the expansion volume. This eliminates its propensity of fuel to dribble through the open injectors into the cylinders and thus eliminates the hot start problem. This approach is particularly suitable for applications having overhead tanks. Still another object of the subject invention is to achieve one or more of the above objects and to provide an varialbe volume chamber fluidically connectable with the common rail and having an internal volume which increases a predetermined amount when expanded from a collapsed condition to a fully expanded condition and expansion control means for causing the variable volume to be held in a collapsed condition during engine operation and to expand upon engine shutdown sufficiently to prevent the flow of fuel frown any injector into the corresponding combustion chamber.

Yet another object of this invention is to provide a leak prevention device in a fuel injection system having an variable volume wherein the amount of expansion volume of the variable volume chamber from its fully collapsed to its fully expanded condition is selected dependent on the effective internal volume of the common rail downstream of the engine's shut off valve and the peak operating pressure and bulk compressibility modulus of the engine's fuel to assure that upon engine shut off the expansion volume is capable of expanding sufficiently to lower the pressure of the fuel sufficiently to prevent fuel from flowing from the common rail into a corresponding combustion chamber of any open nozzle fuel injector that may have a metering chamber in fluid communication with the associated combustion chamber.

Another object of this invention is to achieve one or more of the above objects and to provide a housing assembly for a leakage control device in an open nozzle unit injector containing a cylindrical cavity, a piston reciprocally mounted within said cylindrical cavity to form the variable volume, and biasing means for biasing the piston toward its fully expanded condition.

Still another object of this invention is to achieve one or more of the above objects and to provide a housing assembly for a leakage control device for use in an open nozzle fuel injection system including an inlet passage fluidically connected at one end with the common rail and at the other end with the cylindrical cavity and an inlet check valve for allowing fuel to flow in only one direction from the common rail into the cylindrical cavity.

Another object of this invention is to achieve one or more of the above objects and to provide a leak prevention system adapted to be connected with a fuel drain and to provide a housing assembly further containing an outlet passage fluidically connected at one end with the cylindrical cavity and at the other end with a fuel drain and an outlet check valve located in the outlet passage for allowing fuel to flow in only one direction from the cylindrical cavity into the fuel drain.

Still another object of this invention is to provide one or more of the above objects and to provide a housing assembly containing a control chamber for receiving the variable volume chamber piston upon expansion of the variable volume, and a control passage for fluidically connecting the control chamber with a source of control fluid under sufficient pressure to overcome the bias force applied by the biasing means to the piston and to cause the piston to move in a direction to cause the variable volume to collapse.

Another object of the this invention is to provide one or more of the above objects and to provide expansion control means which includes a three way valve connected with the control passage, a source of control fluid and a fuel drain, wherein the three way valve is movable between a first position in which the control fluid is connected with the control passage to cause the fluid under pressure to flow into the control chamber and the piston to move in a direction to collapse the variable volume and discharge fuel to the fuel drain through the outlet passage, and a second position in which the control passage is connected with the fuel drain to cause fuel to be discharged from the control chamber in response to the piston being displaced into the control chamber by the bias means.

Still another object of this invention is to provide one or more of the above objects and to provide a leakage control device for use in an open nozzle unit fuel injector system including an expansion control means further includes a first solenoid for moving the said shut off valve to its open position when energized, a second solenoid for moving the three way valve to its second position when energized, and a control circuit connected with the first and second solenoids for generating control signals to energize the first and second solenoids during engine start-up and operation and to de-energize the first and second solenoids to cause engine shut off without giving rise to the potential for fuel leakage through the injection orifice of an injector stopped in its metering phase.

The above and other objects are achieved in a common rail, open nozzle fuel injection system for injecting fuel periodically into the combustion chambers of a multi-cylinder internal combustion engine. The disclosed system includes a common rail for supplying fuel from a fuel supply through a common passageway simultaneously to locations, respectively, adjacent the combustion chambers of the multi-cylinder internal combustion engine. Also included are a plurality of fuel injectors fluidically connected with said common rail at said locations, respectively, for periodically injecting controlled quantities of fuel into corresponding combustion chambers. Each said fuel injector has an injector body containing a metering chamber for receiving fuel from the common rail and at least one injection orifice for forming an open pathway for fuel to be injected into the corresponding combusion chamber, and an injector plunger mounted for reciprocal movement within said injector body to define successive cycles including an injection phase during which fuel is forced at high pressure through the injection orifice into the corresponding combustion chamber and a metering phase during which the common rail is connected fluidically with the corresponding metering chamber to cause fuel to be metered into said metering chamber and during which the injection orifice remains open thereby connecting fluidically the common rail with the corresponding combustion chamber through the metering chamber. A shut off valve is also provided within the common rail upstream of the fuel injectors to isolate, when closed, the fuel injectors from the source of fuel under pressure to shut off the engine potentially causing at least one the injector plunger to be stopped while in its metering phase. This condition creates a leakage path for fuel to flow from the common rail through the metering chamber into the corresponding combustion chamber. A leakage prevention means is provided for preventing fuel flow into the combustion chamber of any fuel injector that may be stopped in its metering phase by reducing the fuel pressure within the common rail downstream of the shut off valve. The leakage prevention means includes an variable volume chamber fluidically connectable with the common rail and having an internal volume which increases a predetermined amount when expanded from a collapsed condition to an fully expanded condition. The expansion control means also causes the variable volume to be held in a collapsed condition during engine operation and to expand upon engine shutdown sufficiently to prevent the flow of fuel from any injector into the corresponding combustion chamber.

The above and other objects, improvements and advantages of the subject invention can be understood from the following Brief Description of the Drawings and Detailed Description of the Preferred Embodiments.

DETAILED DESCRIPTION OF THE PREFERRED EMBODIMENTS

Figures 1A, 1B, 1C, 1D:
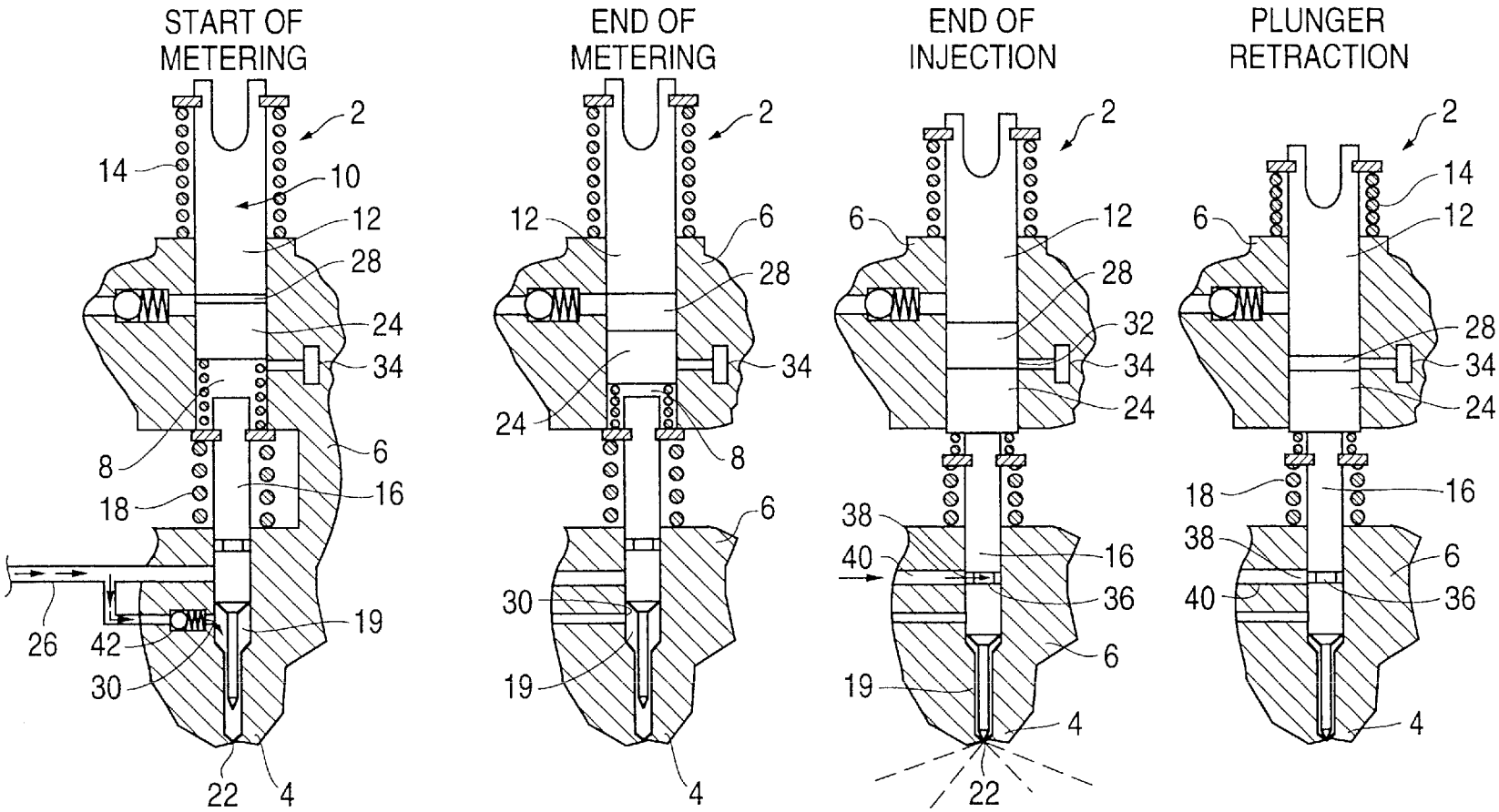
FIGS. 1A through 1D are schematic illustrations of a prior art type, open nozzle, unit fuel injector in various phases of operation that gives rise to the need for a leak prevention apparatus of the subject invention.

The subject invention is designed to solve the problem of undesirable fuel leakage into the combustion chambers of an internal combustion engine equipped with a fuel system including unit injectors having open nozzles of the type developed by the assignee of this invention, Cummins Engine Company, Inc. Throughout this application, the words "inward", and "outward" will correspond to the directions, respectively, toward and away from the point at which fuel from an injector is actually injected into the combustion chamber of the engine. For a better understanding of this type of fuel injection system, reference is made to FIGS. 1A through 1D in which are illustrated schematically the various phases of operation of a typical cam operated, unit injector 2 having an open nozzle 4 through which fuel, in metered quantities, is periodically injected into an associated combustion chamber (not illustrated) of an internal combustion engine. Examples of this type of injector for use in a fuel system for compression ignition engines are disclosed in much greater detail in PCT Application WO 97/06364 to Peters et al. and SAE Technical Paper 961748 entitled "Cummins Quantum CELECT Fuel System Description for the QSK19 Diesel Engine" incorporated herein by reference. Each such injector includes an injector body assembly 6 containing a central bore 8 within which is mounted for reciprocal movement a plunger assembly 10.

The plunger assembly 10 includes an outer plunger 12 biased outwardly by a outer return spring 14 and periodically displaced inwardly, in synchronization with the reciprocal movement of the engine piston (not illustrated) within the cylinder into which the injector is mounted to inject fuel. The plunger assembly 10 also includes an inner plunger 16 biased outwardly by an inner return spring 18 to form a metering chamber 20 at the inner end of central bore 8. As will be explained more fully below, fuel metered into metering chamber 19 is forced through a plurality of small orifices 22 formed in the inner portion (referred to as the nozzle) of the injector body assembly 6 into the combustion chamber of the associated engine cylinder. The exact timing of the injection event may be varied depending on the length of a hydraulic link formed in the plunger assembly 10 on a cycle by cycle basis between outer plunger 12 and an intermediate timing plunger 24.

The amount of fuel injected and the timing of each injection event during each cycle of injector operation is controlled by pressure/time (PT) principles as can be understood more clearly by referring specifically to FIG. 1A. In particular, fuel is supplied to each injector through a common fuel supply rail 26 which may take the form of a drilling formed in the head (not illustrated) of the engine. A metering orifice (not illustrated) is typically included in the fuel flow path supplying each metering chamber 19 to cause the fuel quantity to be dependent on the pressure P of the fuel in the common rail 26 and the amount of time T that the fuel is metered. Similarly the amount of timing fluid (which may be engine fuel) that is metered into the timing chamber 28, formed between the outer plunger 12 and the intermediate timing plunger 24, may be controlled in the same manner.

As illustrated in FIG. 1A, the metering phase of injector operation continues until the associated cam (not illustrated) causes the outer plunger 12 to advance inwardly as illustrated in FIG. 1B to first cut off metering of timing fluid in timing chamber 28 thereby forming a hydraulic link within the timing chamber whose length is determined by the amount of timing, fluid that was metered into the timing chamber 28.

Further advance of the outer plunger 12, as illustrated in FIG. 1B, causes the intermediate timing plunger 24 to advance into engagement with the inner plunger 16 to cause fuel metering to cease as the fuel metering port 30 is closed. Again the amount of fuel metered into the metering chamber will depend on the pressure of the fuel in the common rail 26 and the time that the metering was permitted to continue.

As outer plunger 12 advances further in response to cam rotation, the fuel in metering chamber 19 is subjected to very high pressure (12,000 to 18,000 psi or higher) to cause fuel to be forced through the injection orifices 22 as illustrated in FIG. 1C. When inner plunger 16 reaches its inward most position, intermediate timing plunger 24 is arranged to clear a spill port through which the timing fluid will be spilled to drain 34. By providing an appropriate constriction in the spill path, the timing fluid can be subjected to a controlled pressure which will have the effect of applying a force to the inner plunger 16 tending to hold the timing plunger down.

After the timing chamber 28 is fully collapsed, additional rotation of the injector cam will cause the plunger assembly to retract under the force of inner return spring 18 and outer return spring 14 as illustrated in FIG. 1D. Once fully retracted, the cam is formed to cause the outer plunger to be held in the fully retracted position as illustrated in FIG. 1A to allow metering of both fuel and timing fluid to commence the next cycle of injector operation.

When the inner plunger 16 reaches its inner most position as illustrated in FIGS. 1C and 1D, an annular recess 36 formed in the inner plunger is caused to align with a scavenge port 38. Fuel from the common rail is supplied through a branch 40 to cause fuel to flow through the fuel supply and drain passages of the injector to scavenge gases and to cool the injector.

As is apparent from FIGS. 1A and 1B, metering chamber 19 is fluidically connected with both the common rail 26 and the associated combustion chamber (not illustrated) through injection orifices 22 whenever the plunger assembly 10 is retracted. An check valve 42 may be placed in the fuel feed path upstream of the metering port 30 but this is only effective to provide some isolation against combustion gases entering the common rail 26. Fuel is still permitted to flow from common rail 26 into the metering chamber 19 and to dribble or leak into the combustion chamber whenever the engine is stopped while the injector plunger assembly is in the position shown in FIGS. 1A and 1B. Should the fuel within rail 26 remain under residual pressure upon engine shut off, the migration of fuel into all open nozzle injectors whose inner plungers are retracted are likely to experience at least some leakage of fuel into the associated combustion chamber.

As explained in detail above in the Background, any fuel that leaks into a combustion chamber can cause difficulty upon restarting of the engine. This problem is especially acute when the engine is restarted while still warm from previous use. Hot start problems are particularly prevalent when an engine is restarted after less than 10 minutes such as occurs frequently when the engine is used on a delivery truck or other vehicle that is frequently stopped and started. Even greater difficulty arises when the engine is installed with an overhead fuel tank used in certain off highway industrial applications. Such applications employ a 5 psi check valve to resist normal scavenging and thus the amount of fuel that is leaked upon shut off by open injectors is increased. Hot start kits used in the past to solve this problems as disclosed for example in Cummins own U.S. Pat. No. 5,159,911 to Williams are not entirely satisfactory, especially in overhead tank installations, and are relatively complex and expensive as compared with the solution embodied in the present invention.

Figure 2:
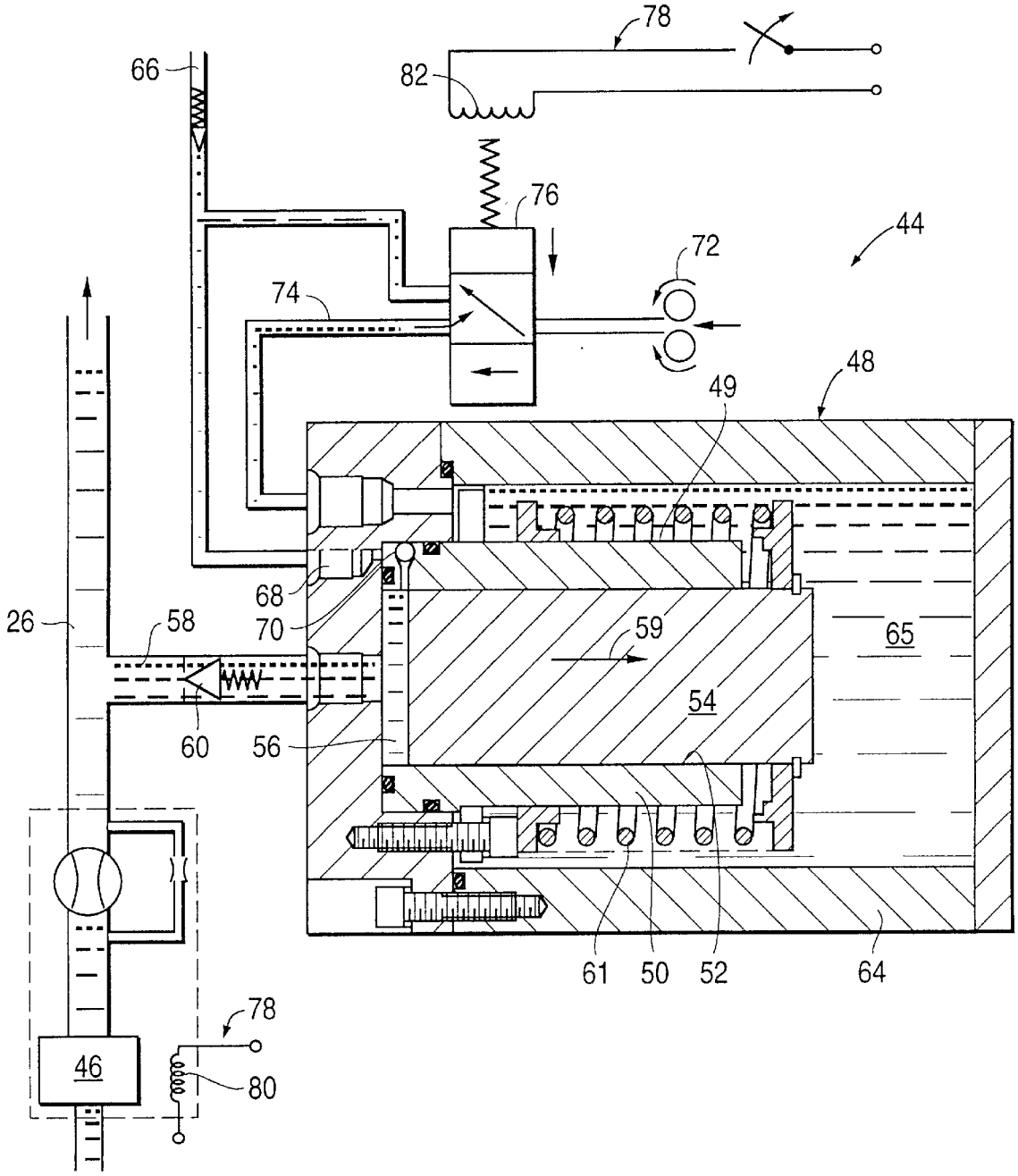
FIG. 2 is a schematic illustration of a leakage prevention device designed in accordance with the subject invention just as the engine on which it is used is shut down.

Referring now to FIGS. 2–7, particularly FIG. 2, a leak prevention device, designed in accordance with the subject invention, is disclosed for use in a fuel system employing open nozzle, unit injectors of the type disclosed in FIGS. 1A–1D. FIG. 2 illustrates a leakage prevention device 44 designed in accordance with the subject invention connected fluidically with the common rail 26 down stream of the fuel shut off valve (FSOV) 46 but up stream of the unit injectors (not illustrated) fluidically connected with the common rail. Leakage prevention device 44 includes a housing assembly 48 having an expandable volume chamber 49 formed by an inner housing 50 containing a cylindrical cavity 52 within which is mounted for reciprocal movement a piston 54 for defining a variable volume 56. Cylindrical cavity 52 is fluidically connected with common rail 26 through an inlet passage 58 in which is located an inlet check valve 60 arranged to allow fuel to flow into the variable volume 56 from the common rail 26 but not in the reverse direction.

Piston 54 is biased in the direction of arrow 59 by a biasing means such as spring 61 surrounding inner housing 50 to cause the variable volume to expand. The amount of expansion volume of the variable volume 56 from its fully collapsed to its fully expanded condition is selected dependent on the effective internal volume of the common rail 26 downstream of the shut off valve 46 and the peak operating pressure and bulk compressibility modulus of the fuel. More particularly, the amount of expansion volume is selected to assure that upon engine shut off, the expansion volume will be sufficient to permit sufficient flow of fuel into the variable volume 56 to lower the pressure of the fuel sufficiently to prevent fuel from flowing from the common rail 26 into a corresponding combustion chamber of any fuel injector that may be in its metering phase at the moment of engine shut off.

Housing assembly 48 further includes an outer housing 64 surrounding inner housing 50. Outer housing 64 contains a control chamber 65 within which is mounted the biasing spring 61. As will be explained more fully below, a control fluid, such as fuel, under pressure is controllably directed into the control chamber 65. The control fluid is at a pressure sufficient to overcome the bias force applied to piston 54 by spring 61 and the pressure of fuel from the common rail within the variable volume 56 to cause piston 54 to move in the direction opposite of arrow 59 to collapse the variable volume 56 and force the fuel contained therein out of the variable volume 56. The variable volume 56 is fluidically connected with a fuel drain 66 by a outlet passage 68. Within outlet passage 68 is a gravity biased outlet check valve 70 which allows fuel to flow out of variable volume 56 whenever piston 54 moves in the direction opposite arrow 59 to cause the variable volume 56 to collapse.

The source of the control fluid may be the conventional fuel gear pump 72 which is normally employed in fuel systems for compression ignition engines and will normally supply fuel at a pressure sufficient to force piston 54 in the direction to collapse variable volume 56. Fuel from pump 72 is supplied to one end of a control passage 74 connected at one end to the control chamber 65.

A solenoid operated, three way valve 76 is provided in control passage 74 to allow the fuel from gear pump 72 to be shut off. Three way valve 76 forms part of an expansion control means 78 for causing the variable volume 56 to be held in a collapsed condition during engine operation and to expand upon engine shutdown sufficiently to prevent the flow of fuel from any injector into the corresponding combustion chamber. Three way valve 76 is movable between a first position in which the control fluid is connected with the control passage 74 to cause the fluid under pressure to flow into control chamber 65 and piston move in a direction to collapse the variable volume 56 and discharge fuel to the fuel drain 66 through outlet passage 68, and a second position in which the control passage 74 is connected with the fuel drain 66 to cause fuel to be discharged from the control chamber 65 in response to the piston 54 being displaced into the control chamber 65 by the spring 61 and the pressure of the fuel in the common rail 26.

The expansion control means also includes a pair of solenoids including a first solenoid 80 for moving the shut off valve 46 to its open position when energized. A second solenoid 82 is also provided for moving the three way valve 76 to its second position when energized. A control circuit (not illustrated) is connected with the first and second solenoids for generating control signals to energize the first and second solenoids during engine start-up and operation and to de-energize the first and second solenoids to cause engine shut off without giving rise to the potential for fuel leakage through the injection orifice of an injector stopped in its metering phase.

Figure 3:
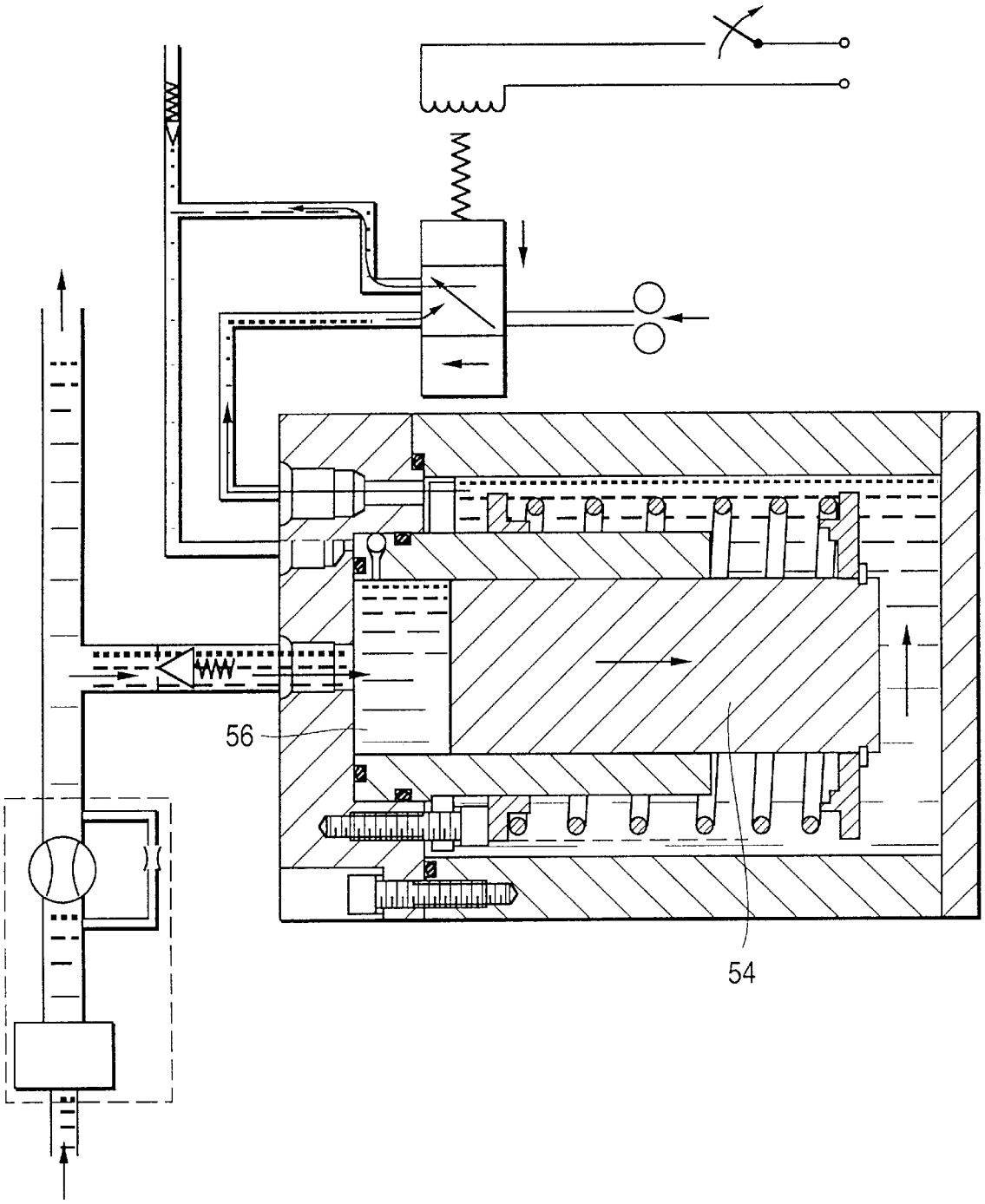
FIG. 3 is a schematic illustration of the leakage prevention device of FIG. 2 shortly after engine shut down has been completed.

In FIG. 2 the leakage prevention device 44 is in the condition it would assume just as the engine key switch is opened causing the first and second solenoids to be de-energized. As noted above, such de-energization will cause the fuel shut off valve 46 to close and will cause the three way valve 76 to move to its second position to allow the control fluid (fuel) within control chamber 65 to be discharged. FIG. 3 illustrates the condition assumed by the leakage prevention device 44 as the piston 54 reaches its fully extended condition causing the variable volume 56 to be fully expanded. As also noted above the amount of expansion of variable volume 56 is sufficient to assure that the pressure of the fuel in the common rail will have dropped sufficiently to preclude leakage through any injector that may have stopped in its metering phase as illustrated in FIG. 1A.

Figure 4:
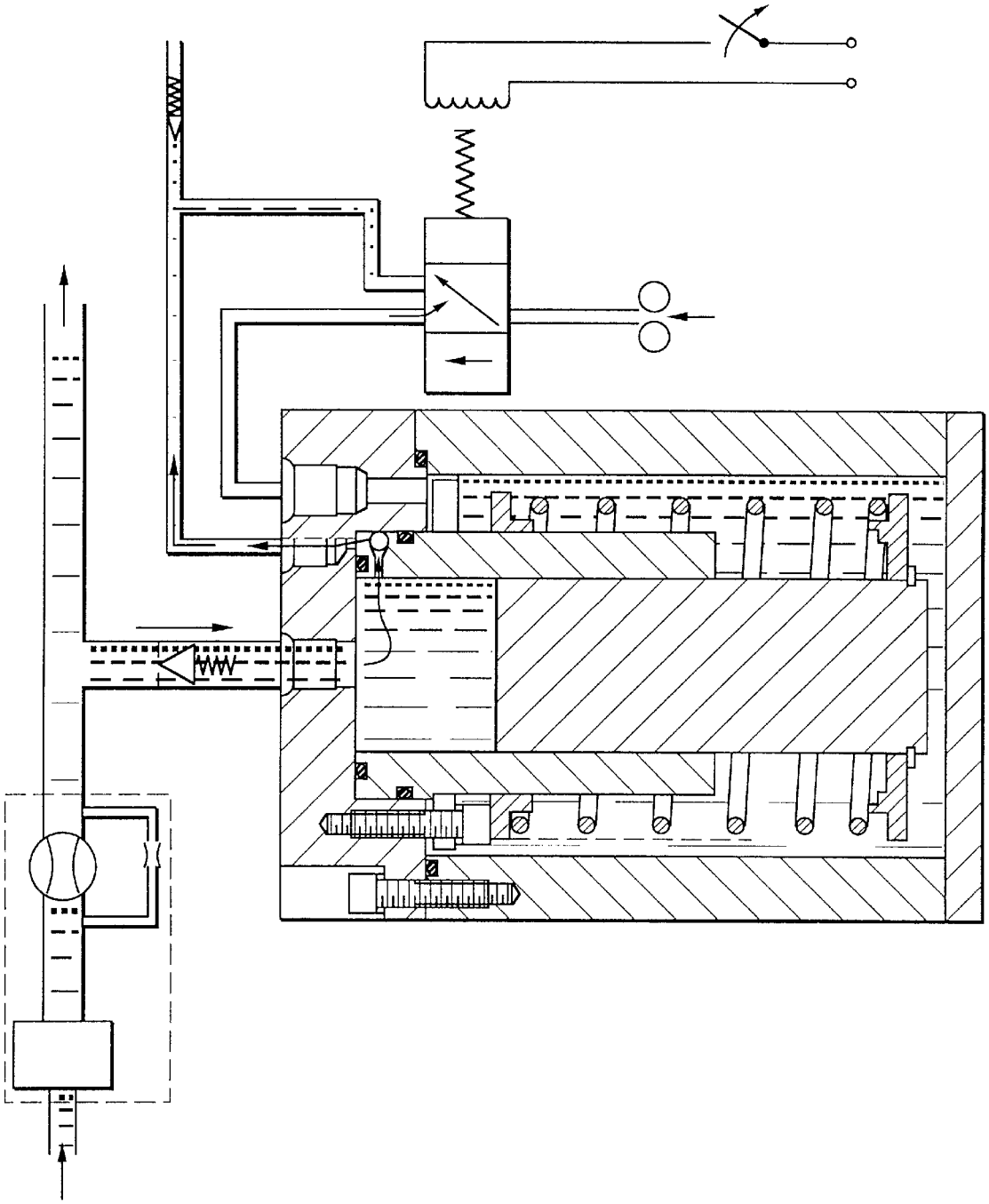
FIG. 4 is a schematic illustration of the leakage prevention device of FIG. 2 after engine shut down has been completed and residual pressure arises in the fuel contained in the common rail.
Figure 5:
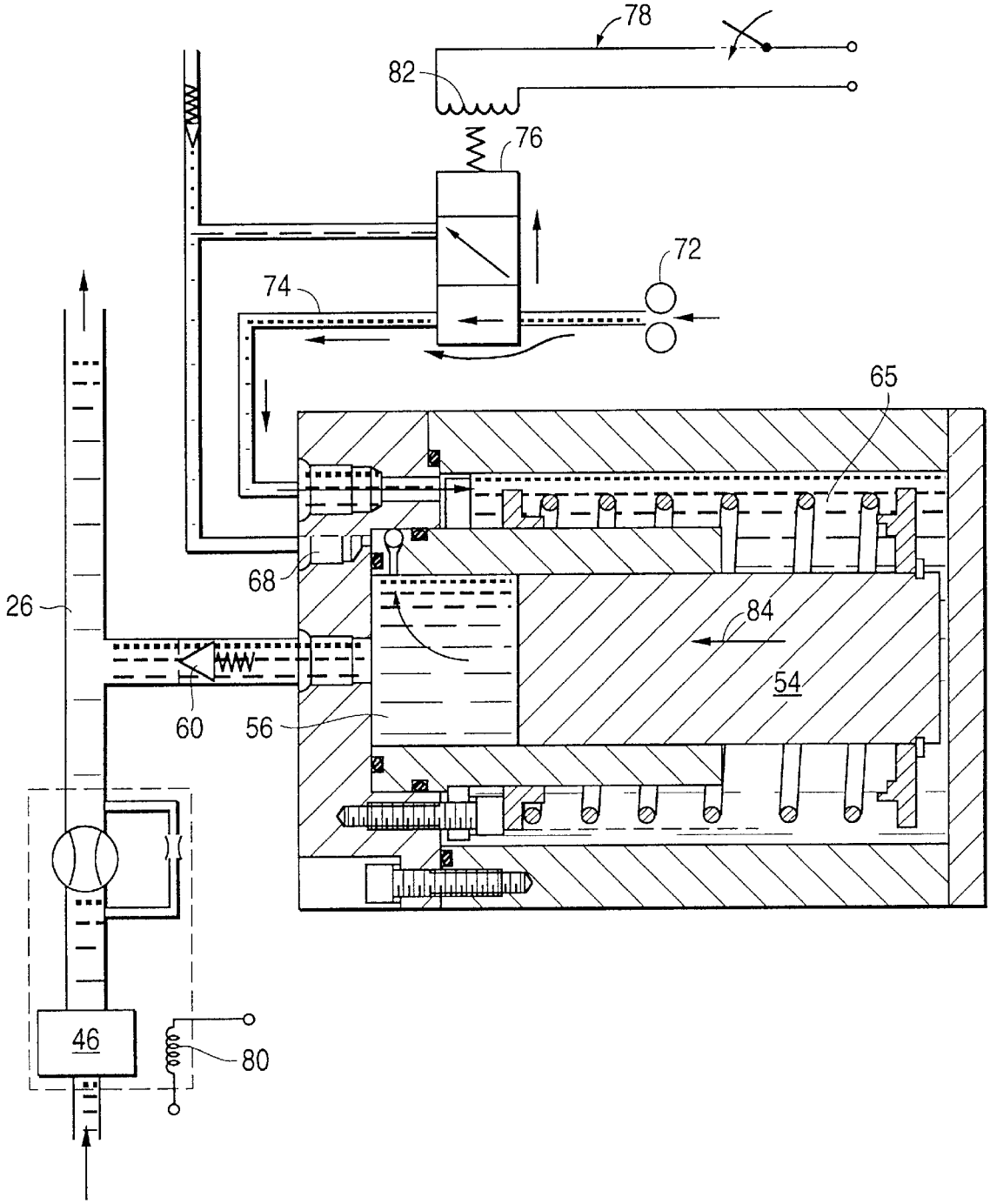
FIG. 5 is a schematic illustration of the leakage prevention device of FIG. 2 as the engine is started up.
Figure 6:
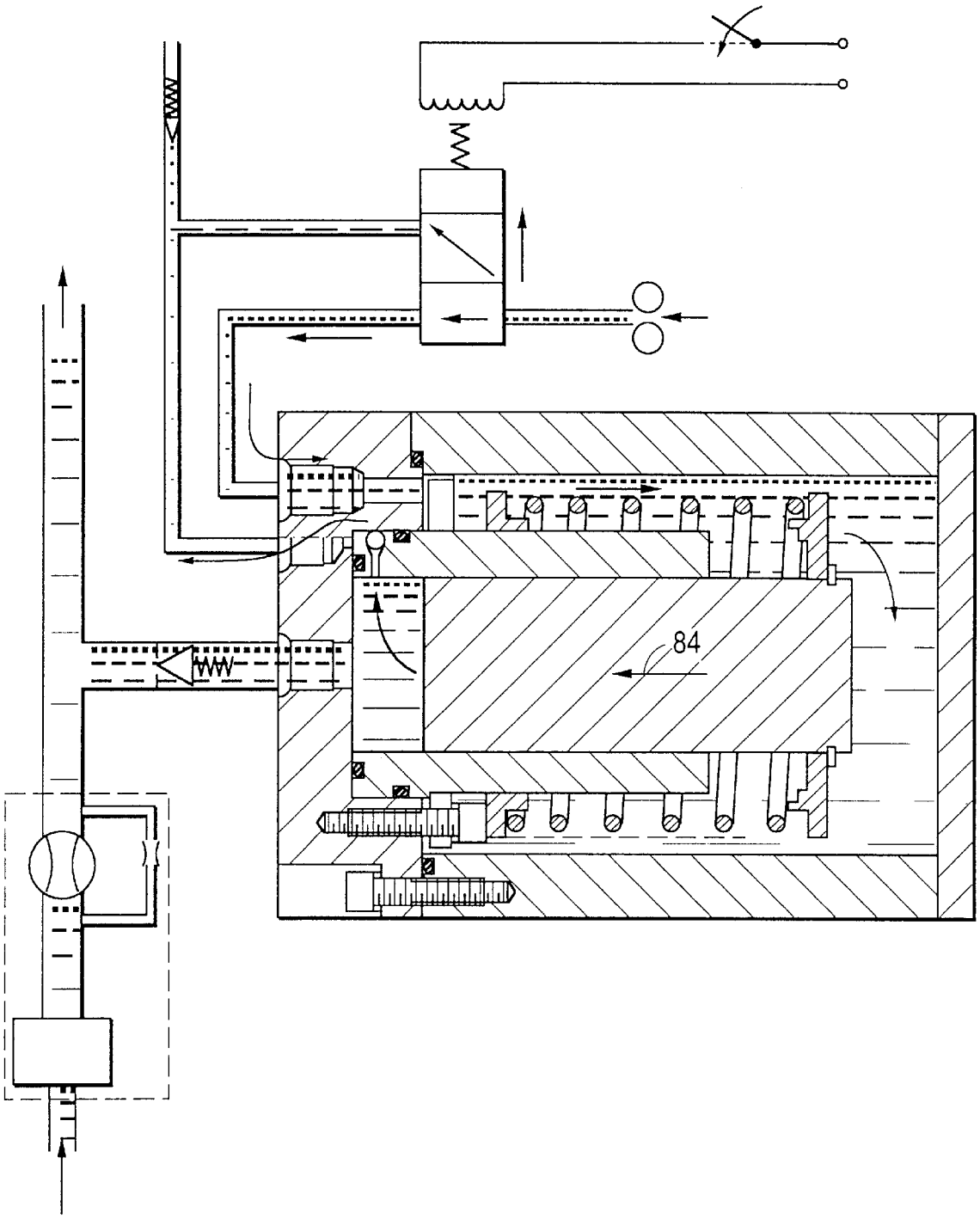
FIG. 6 is a schematic illustration of the leakage prevention device of FIG. 2 as the engine start up is nearing completion.

FIG. 4 illustrates the path of flow of fuel should any residual pressure remain or arise in the fuel within the common rail 26. FIGS. 5 and 6 demonstrates the result of engine start up when the expansion control means 78 causes the first and second solenoids 80 and 82 are energized. In particular, three way valve 76 is moved to its first position in which fuel from the gear pump 72 is directed via control passage 74 into the control chamber 65 to cause piston 54 to move in the direction of arrow 84 to collapse the variable volume 56 and discharge fuel to the outlet passage 68. Inlet check valve 60 prevents fuel from flowing back into common rail 26.

Figure 7:
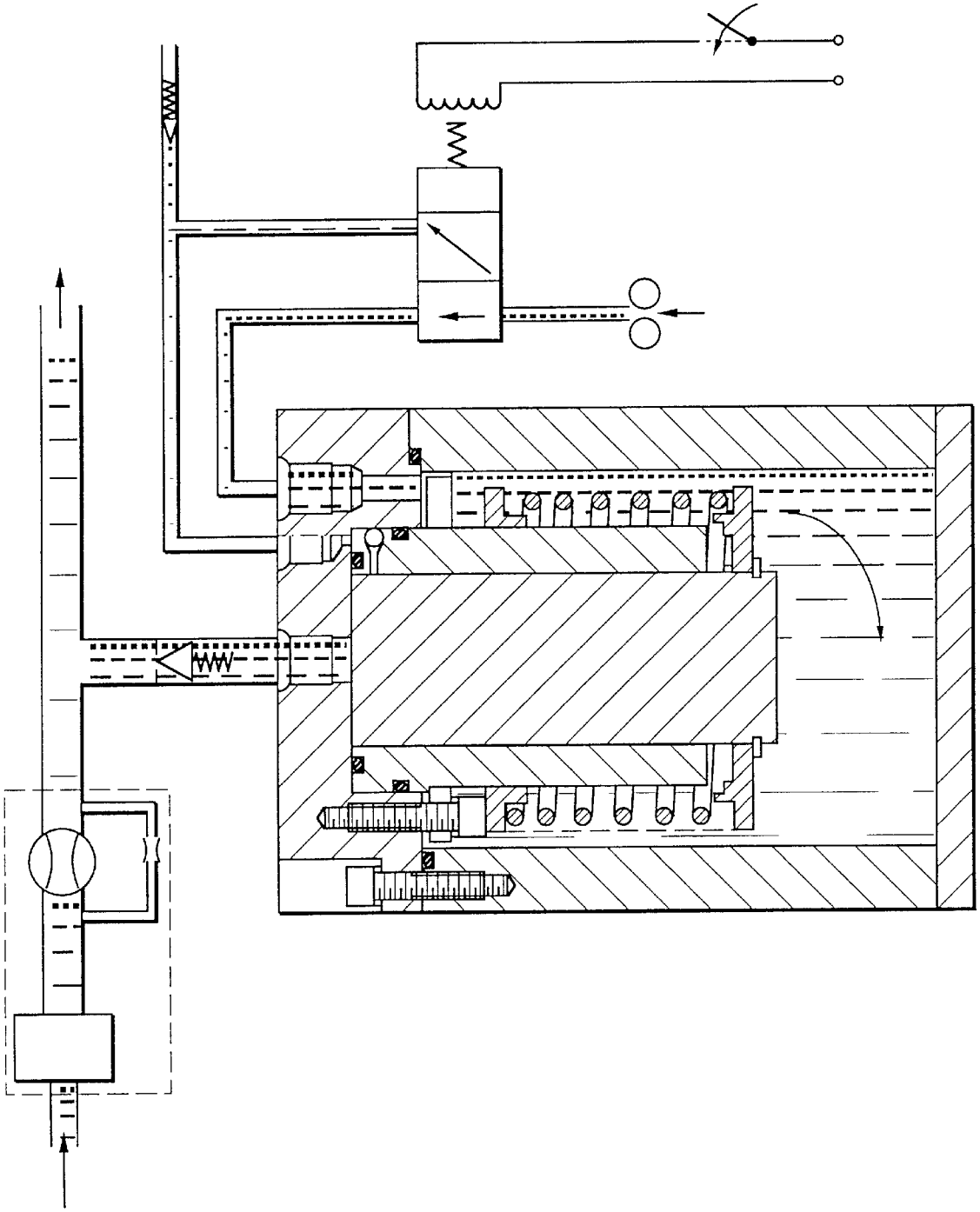
FIG. 7 is a schematic illustration of the leakage prevention device of FIG. 2 as the engine start up is completed.

FIG. 7 illustrates the condition of the leakage prevention device 44 after piston has been displaced to cause the variable volume 56 to be fully collapsed. This is the condition assumed by the leakage prevention device 44 when the associated engine is operating and first and second solenoids 80 and 82 are energized by the expansion control means 78.

As can now be appreciated, the subject invention achieves the various objectives listed above by operating to quickly and effectively reduce the pressure of fuel in the engine's common rail sufficiently to preclude fuel leakage into the combustion chambers of an engine equipped with open nozzle, unit injectors even when the injectors are stopped in their metering phase as illustrated in FIG. 1A. The leakage prevention device 44 of the subject invention continues to provide a drain path for fuel residing within the common rail during engine shut off and requires no energization of the control solenoids during this phase of operation. Numerous other objectives, advantages and functions are achieved as set forth above and as can be appreciated by practitioners by obvious variations of the system disclosed herein. For example, the open nozzle injectors disclosed herein could be replace with unit injectors that employ hydraulic intensification rather than cam operation. Numerous other variations are within the scope of this invention.

Industrial Applicability

The subject invention can be applied to any engine equipped with a fuel system that includes open nozzle unit injectors but will have particular utility on compression ignition engines employing high pressure fuel systems. The subject invention is particularly suitable for use on off highway engines used in various industrial applications especially engines having an overhead fuel tank.

We claim:

1. A common rail, open nozzle fuel injection system for injecting fuel periodically into the combustion chambers of a multi-cylinder internal combustion engine, comprising a common rail for supplying fuel from a fuel supply through a common passageway simultaneously to locations, respectively, adjacent the combustion chambers of the multi-cylinder internal combustion engine;

a plurality of fuel injectors fluidically connected with said common rail at said locations, respectively, for periodically injecting controlled quantities of fuel into corresponding combustion chambers, each said fuel injector having an injector body containing a metering chamber for receiving fuel from the common rail and at least one injection orifice for forming an open pathway for fuel to be injected into the corresponding combustion chamber, and an injector plunger mounted for reciprocal movement within said injector body to define successive cycles including an injection phase during which fuel is forced at high pressure through said injection orifice into the corresponding combustion chamber and a metering phase during which said common rail is connected fluidically with the corresponding metering chamber to cause fuel to be metered into said metering chamber and during which said injection orifice remains open thereby connecting fluidically said common rail with the corresponding combustion chamber through said metering chamber;

a shut off valve mounted within said common rail upstream of said fuel injectors to isolate, when closed, said fuel injectors from the source of fuel under pressure to shut off the engine potentially causing at least one said injector plunger to be stopped while in its metering phase thereby creating a leakage path for fuel to flow from said common rail through said metering chamber into the corresponding combustion chamber; and leakage prevention means for preventing fuel flow into the combustion chamber of any said fuel injector that may be stopped in its metering phase by reducing the fuel pressure within said common rail downstream of said shut off valve, said leakage prevention means including an variable volume chamber fluidically connectable with the common rail and having an internal volume which increases a predetermined amount when expanded from a collapsed condition to an fully expanded condition, and expansion control means for causing said variable volume to be held in a collapsed condition during engine operation and to expand upon engine shutdown sufficiently to prevent the flow of fuel from any injector into the corresponding combustion chamber.

2. A fuel injection system as defined in claim 1, wherein said predetermined amount of expansion volume of said variable volume chamber from said collapsed to said fully expanded condition is selected dependent on the effective internal volume of the common rail downstream of the shut off valve and the peak operating pressure and bulk compressibility modulus of the fuel to assure that upon engine shut off said predetermined amount of expansion volume is capable of expanding sufficiently to lower the pressure of the fuel sufficiently to prevent fuel from flowing from the common rail into a corresponding combustion chamber of any fuel injector that may be in its metering phase at the moment of engine shut off.

3. A fuel injection system as defined in claim 1, wherein said variable volume chamber includes a housing assembly containing a cylindrical cavity, a piston reciprocally mounted within said cylindrical cavity to form said variable volume, and biasing means for biasing said piston toward said fully expanded condition.

4. A fuel injection system as defined in claim 3, wherein said housing assembly contains an inlet passage fluidically connected at one end with said common rail and at the other end with said cylindrical cavity and an inlet check valve for allowing fuel to flow in only one direction from said common rail into said cylindrical cavity.

5. A fuel injection system as defined in claim 4, wherein the system is adapted to be connected with a fuel drain and said housing assembly further contains an outlet passage fluidically connected at one end with said cylindrical cavity and at the other end with a fuel drain and an outlet check valve for allowing fuel to flow in only one direction from said cylindrical cavity into the fuel drain.

6. A fuel injection system as defined in claim 5, wherein said housing assembly contains a control chamber for receiving said piston as said varialbe volume is expanded, and a control passage for fluidically connecting said control chamber with a source of control fluid under sufficient pressure to overcome the bias force applied by said biasing means to said piston and to cause said piston move in a direction to cause said variable volume to collapse.

7. A fuel injection system as defined in claim 6, wherein said expansion control means includes a three way valve connected with said control passage, said source of control fluid and said fuel drain, said three way valve being movable between a first position in which said control fluid is connected with said control passage to cause said fluid under pressure to flow into said control chamber and said piston move in a direction to collapse said variable volume and discharge fuel to said fuel drain through said outlet passage, and a second position in which said control passage is connected with said fuel drain to cause fuel to be discharged from said control chamber in response to said piston being displaced into said control chamber by said bias means.

8. A fuel injection system as defined in claim 7, wherein said expansion control means further includes a first solenoid for moving said shut off valve to its open position when energized, a second solenoid for moving said three way valve to its second position when energized, and a control circuit connected with said first and second solenoids for generating control signals to energize said first and second solenoids during engine start-up and operation and to de-energize said first and second solenoids to cause engine shut off without giving rise to the potential for fuel leakage through said injection orifice of an injector stopped in its metering phase.

9. A leak prevention device for preventing fuel leakage into the combustion chambers of a multi-cylinder internal combustion engine equipped with a fuel injection system including a plurality of injectors and a common rail for supplying fuel to the injectors from a fuel supply and further including a shut off valve mounted in the common rail upstream of the fuel injectors to isolate, when closed, the fuel injectors from the source of fuel under pressure to shut off the engine wherein each injector operates to receive during a metering phase a metered quantity of fuel from the common rail and to inject during a subsequent injection phase the metered quantity of fuel through an injection orifice into a corresponding combustion chamber of the multi-cylinder internal combustion engine and wherein, during the metering phase, the common rail is connected fluidically with the injection orifice such that upon engine shut off at least one injector may be stopped while in its metering phase thereby creating a leakage path for fuel to flow from the common rail into corresponding combustion chamber, whereby said apparatus comprises:

leakage prevention means for preventing fuel flow into a combustion chamber from the corresponding fuel injector that may be stopped in its metering phase by reducing the fuel pressure within the common rail downstream of the shut off valve, said leakage prevention means including an variable volume chamber fluidically connectable with the common rail and having an internal volume which increases a predetermined amount when expanded from a collapsed condition to an fully expanded condition, and expansion control means for causing said variable volume to be held in its collapsed condition during engine operation and to expand upon engine shutdown sufficiently to prevent the flow of fuel from any injector into the corresponding combustion chamber.

10. A leak prevention device as defined in claim 9, wherein said predetermined amount of expansion volume of said variable volume chamber is selected dependent on the effective internal volume of the common rail downstream of the shut off valve and the peak operating pressure and bulk compressibility modulus of the fuel to assure that upon engine shut off said variable volume chamber is capable of expanding sufficiently to lower the pressure of the fuel sufficiently to prevent fuel from flowing from the common rail into a corresponding combustion chamber of any fuel injector that may be in its metering phase at the moment of engine shut off.

11. A leak prevention device as defined in claim 9, wherein said variable volume chamber includes a housing assembly containing a cylindrical cavity, a piston reciprocally mounted within said cylindrical cavity to form said variable volume, and biasing means for biasing said piston toward said fully expanded condition.

12. A leak prevention device as defined in claim 3, wherein said housing assembly contains an inlet passage fluidically connected at one end with the common rail and at the other end with said cylindrical cavity and an inlet check valve for allowing fuel to flow in only one direction from the common rail into said cylindrical cavity.

13. A leak prevention device as defined in claim 4, wherein the device is adapted to be connected with a fuel drain and said housing assembly further contains an outlet passage fluidically connected at one end with said cylindrical cavity and at the other end with a fuel drain and an outlet check valve for allowing fuel to flow in only one direction from said cylindrical cavity into the fuel drain.

14. A leak prevention device as defined in claim 5, wherein said housing assembly contains a control chamber for receiving said piston as said varialbe volume is expanded, and a control passage for fluidically connecting said control chamber with a source of control fluid under sufficient pressure to overcome the bias force applied by said biasing means to said piston and to cause said piston move in a direction to cause said variable volume to collapse.

15. A leak prevention device as defined in claim 6, wherein said expansion control means includes a three way valve connected with said control passage, the source of control fluid and the fuel drain, said three way valve being movable between a first position in which the source of control fluid is connected with said control passage to cause said fluid under pressure to flow into said control chamber to cause said piston to move in a direction to collapse said variable volume and discharge fuel to said fuel drain through said outlet passage, and a second position in which said control passage is connected with the fuel drain to cause fuel to be discharged from said control chamber in response to said piston being displaced into said control chamber by said bias means.

16. A leak prevention device as defined in claim 7, wherein said expansion control means further includes a first solenoid for moving, said shut off valve to its open position when energized, a second solenoid for moving said three way valve to its second position when energized, and a control circuit connected with said first and second solenoids for generating control signals to energize said first and second solenoids during engine start-up and operation and to de-energize said first and second solenoids to cause engine shut off without giving rise to the potential for fuel leakage through an injector stopped in its metering phase.

* * * * *